US012495885B2

(12) United States Patent
Eberle et al.

(10) Patent No.: US 12,495,885 B2
(45) Date of Patent: Dec. 16, 2025

(54) BACKPACK ASSEMBLY WITH LOAD SLING

(71) Applicant: Eberlestock USA LLC, Boise, ID (US)

(72) Inventors: Glen R. Eberle, Boise, ID (US); Nathaniel C.B. Tong, Boise, ID (US)

(73) Assignee: Eberlestock USA LLC, Boise, ID (US)

( * ) Notice: Subject to any disclaimer, the term of this patent is extended or adjusted under 35 U.S.C. 154(b) by 258 days.

(21) Appl. No.: 18/312,055

(22) Filed: May 4, 2023

(65) Prior Publication Data

US 2024/0365955 A1 Nov. 7, 2024

(51) Int. Cl.

| | |
|---|---|
| ***A45F 3/08*** | (2006.01) |
| ***A45F 3/04*** | (2006.01) |
| *A45F 3/00* | (2006.01) |
| *F41C 33/02* | (2006.01) |

(52) U.S. Cl.

CPC ..... *A45F 3/08* (2013.01); *A45F 3/047* (2013.01); *A45F 2003/003* (2013.01); *A45F 2003/045* (2013.01); *F41C 33/0209* (2013.01)

(58) Field of Classification Search

CPC ..... A45F 3/08

See application file for complete search history.

(56) References Cited

U.S. PATENT DOCUMENTS

| | | | | |
|---|---|---|---|---|
| 5,579,966 | A * | 12/1996 | Krumweide | A45F 3/08 294/157 |
| 6,763,987 | B1 | 7/2004 | Eberle | |
| 7,735,701 | B2 | 6/2010 | Eberle | |
| 8,123,093 | B2 * | 2/2012 | Merzon | A45F 5/02 224/259 |
| 8,348,114 | B2 * | 1/2013 | Gleason, Jr. | A45F 3/08 224/633 |
| 8,579,171 | B2 * | 11/2013 | Gleason, Jr. | A45F 3/08 224/633 |
| D710,086 | S * | 8/2014 | Szewczyk | D3/217 |
| 9,049,916 | B2 * | 6/2015 | Berei | A45F 3/04 |
| 10,072,906 | B2 | 9/2018 | Eberle | |
| 10,299,571 | B2 | 5/2019 | Eberle | |
| D893,168 | S * | 8/2020 | Smith | D3/217 |
| 10,842,245 | B2 * | 11/2020 | Revels | A45F 3/08 |
| 10,952,523 | B2 * | 3/2021 | Rich | A45C 7/0022 |
| 11,330,892 | B2 * | 5/2022 | Yoo | A45C 7/0063 |
| 11,547,200 | B2 * | 1/2023 | Revels | A45F 3/08 |
| D977,244 | S * | 2/2023 | Henderson | D3/217 |
| D984,799 | S * | 5/2023 | Zhang | D3/217 |
| 2008/0030015 | A1 | 2/2008 | Merzon | |
| 2013/0087589 | A1 | 4/2013 | Gleason, Jr. | |
| 2016/0133239 | A1 * | 5/2016 | Hook | A45F 3/047 224/654 |
| 2020/0107630 | A1 | 4/2020 | Rich et al. | |
| 2021/0219703 | A1 | 7/2021 | Yoo | |

OTHER PUBLICATIONS

Extended European Search Report dated Jun. 4, 2024 for European Patent Application No. 23217319.5 (6 pages).

* cited by examiner

*Primary Examiner* — Justin M Larson

(74) *Attorney, Agent, or Firm* — TAYLOR & EDELSTEIN, PC

(57) ABSTRACT

A backpack assembly includes: a main bag; and a load sling coupled with the main bag and configured for supporting a load.

16 Claims, 10 Drawing Sheets

BACKPACK ASSEMBLY WITH LOAD SLING

BACKGROUND OF THE INVENTION

1. Field of the Invention

The present invention relates to outdoor gear, and, more particularly, to backpacks.

2. Description of the Related Art

Backpacks are generally used to carry various articles, such as books, food, etc. In the case of backpacks used for hunting or military applications, they can carry optics, food, water, survival gear, bedding, etc. They can also be used to carry weapons, such as long guns, or, after a successful hunt, the meat of wild game that is being carried out of the backcountry. Whatever the load is that is to be carried, certain loads can be carried inside a bag of the backpack, and other loads can be carried outside the backpack bag.

With respect to carrying the meat of wild game, it is known to use a backpack with an external frame. The external frame may have a shelf, which may be formed rigidly integral with other parts of the external frame, or, alternatively, rigid and foldable (i.e., hingedly attached) relative to other parts of the external frame. After processing the meat and placing the meat in a wild game bag, the user may place the wild game bag on the shelf and further strap the wild game to the external frame and then hang the backpack bag (the main bag) to another part (i.e., top corners) of the external frame, all for the user's walk out of the backcountry.

However, problems exist with using such a design. First, such an external frame can be bulky, which may be undesirable. Second, a popular choice with respect to backpack frames is an internal frame. Thus, carrying a wild game bag filled with meat-or any other sort of bag-cannot be used as described above if using an internal frame.

What is needed in the art is an internally-framed backpack that can effectively and efficiently carry an additional load in addition to the main bag of the backpack.

SUMMARY OF THE INVENTION

The present invention provides a backpack assembly with a load sling configured for carrying a load.

The invention in one form is directed to a backpack assembly which includes: a main bag; and a load sling coupled with the main bag and configured for supporting a load.

The invention in another form is directed to a method of using a backpack assembly, the method including the steps of: providing a main bag; coupling a load sling with the main bag; and supporting a load by the load sling.

An advantage of the present invention is that it provides a load sling, for carrying different types of loads. One such load can be harvested game meat being carried in a bag such as a game bag, such that the backpack assembly functions as a meat hauler in addition to any other functions.

Another advantage of the present invention is that the backpack assembly can include an internal frame, rather than an external frame.

Yet another advantage of the present invention is that the backpack assembly can include a long gun scabbard.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
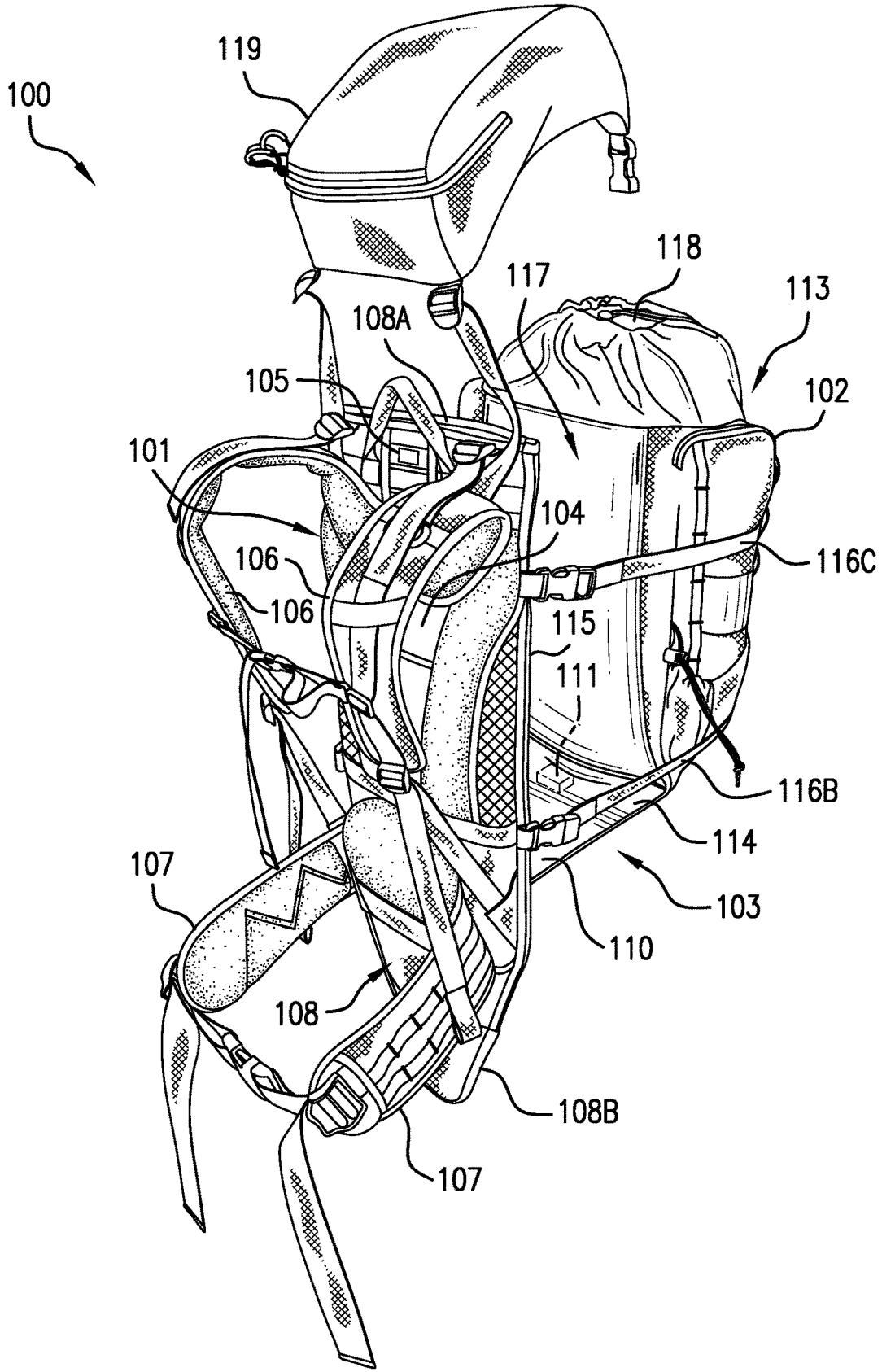
FIG. 1 is a perspective view of a backpack assembly including a frame section, a main bag, and a load sling, the frame section including a long gun scabbard, the load sling being in an extended position, in accordance with an exemplary embodiment of the present invention.

Referring now to the drawings, and more particularly to FIG. 1, there is shown a perspective view of a backpack assembly 100 which generally includes a frame section 101, a main bag 102, and a load sling 103. Frame section 101, main bag 102, and load sling 103 are coupled with one another, with load sling 103 being shown in an extended position 113 (which can also be referred to as a deployed position) in FIGS. 1-6 (load sling 103 is shown in a retracted position 712 in FIG. 7).

Frame section 101 includes a base 104 and an internal frame 104 (shown schematically and not to scale). Base 104 can be made of a flexible fabric material and define an interior portion. Internal frame 105 can be housed within the interior portion of base 104 and can, for example, include stiff internal plastic insert(s) that provide stiffness to frame section 101 (internal frame 105 is shown schematically in FIG. 1).

Frame section 101 further includes shoulder straps 106 and, optionally, a waist belt 107, shoulder straps 106 and waist belt 107 being coupled with base 104. Shoulder straps 106 are configured for being worn over shoulders of a user so as thereby to carry backpack assembly 100 and are adjustable in length to fit the user. Waist belt 107 is configured for distributing part of the weight of backpack assembly 100 to hips of the user and includes two opposing halves which are configured for being releasably connected together around the user's waist such as by way of mating clips or the like.

Frame section 101 further includes weapon carrier 108 which is positioned adjacent to and coupled with base 104 and thus between base 104 and main bag 102. Weapon carrier 108 and base 104 can optionally share a wall (of frame section 101) therebetween, or alternatively each of weapon carrier 108 and base 104 can include their own respective wall which is attached to the other. Weapon carrier 108 is thus formed integral with frame section 101. Weapon carrier 108 is formed as a long gun scabbard 108 (and thus can be referred to herein as a scabbard or long gun scabbard), which is configured for carrying a long gun 309 therein in a barrel-down configuration (for illustrative purposes, shown in FIG. 3 only). "Long gun" includes, for example, rifles (including carbines) and shotguns. Long gun 309 is shown in broken lines as a rifle in FIG. 3. Scabbard 108 is made of a flexible fabric material and includes an interior portion therein in which to store long gun 309.

Scabbard 108 includes an upper section 108A and a lower section 108B, which can be formed integral with one another. Upper section 108A is adjacent to base 104 and can have substantially the same length and width as base 104. Upper section 108A can include a top opening which enables user to access the interior portion of scabbard 108 and to store gun 309 therein. Lower section 108B can form a taper and extend below upper section 108A and thus also lower than base 104. Upper and lower sections 108A, 108B co-act with one another to receive long gun 309 and can together be long and wide enough to accommodate any type of long gun 309, for example and not by way of limitation, a bolt action rifle or an AR-15 style rifle with a pistol grip and a top rail with a telescopic sight and/or a gun with a folding stock. Depending upon the length and configuration of gun 309, gun 309 can be housed entirely within scabbard 108 or extend out a top of upper section 108A. Scabbard 108 thus forms a compartment in which to store long gun 309. The compartment formed by scabbard 108 can be separate from a compartment formed by base which receives and stores therein internal frame 105.

Main bag 102 is configured to provide the main storage area(s) of backpack assembly 100. Main bag 102 can have any suitable configuration. For instance, main bag 102 can include one or more compartments in which to store items. One such compartment can optionally be accessible way of an opening 118 in a top of main bag 102.

Figure 4:
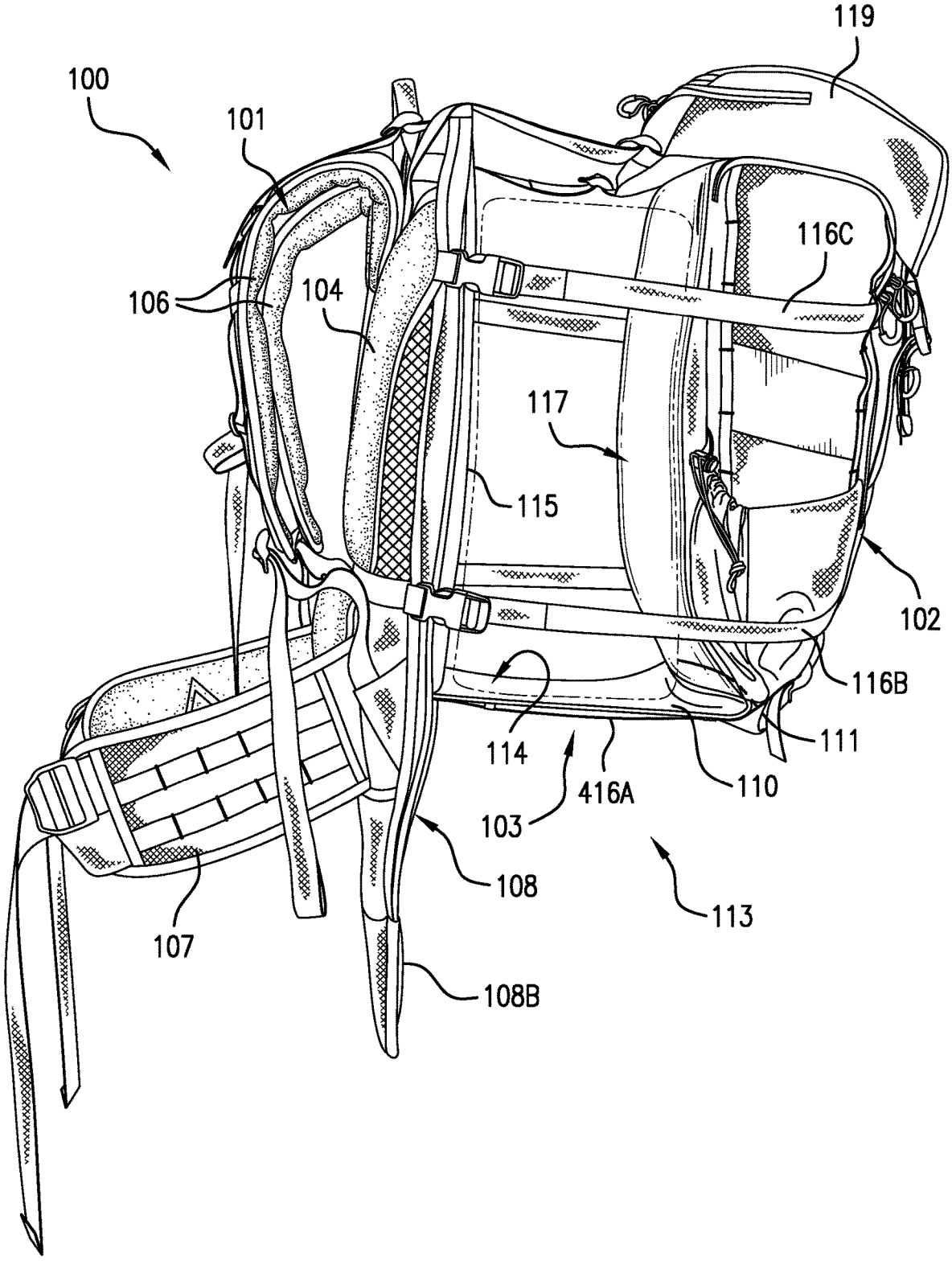
FIG. 4 is a right side perspective view of the backpack assembly of FIG. 1, the left side of the backpack assembly being substantially similar thereto, in accordance with an exemplary embodiment of the present invention.

Load sling 103 is configured for supporting a load 111 (shown schematically in FIG. 1, and as a bag in FIG. 4). Load 111 can be any load. One example (which is provided by way of example and not limitation) of such a load 111 includes a wild game bag with wild game meat stored therein (load 111 being shown in broken lines). According to one embodiment of the present invention, load sling 103 includes a central fabric panel 110 (which is flexible), which is at least in part connected to, and positioned between, frame section 101 and main bag 102. Load sling 103 is configured for moving selectively between a retracted position 712 (FIG. 7) and an extended position 113, or at intermediate positions therebetween. Retracted position 712 is used when load sling 103 is not being used to carry load 111. Extended position 113, or the intermediate positions, are used when load sling 103 is being used to carry load 111. Load sling 103 can be connected to frame section 101 and main bag 102 in any suitable manner. According to one embodiment of the present invention, load sling 103 includes fabric panel 114, which includes central fabric panel 110 and frame-side fabric panel 115, such that central fabric panel 110 and frame-side fabric panel 115 are substantially continuous with one another. Central fabric panel 110 attaches to main bag 102 at one end of central fabric panel 110 (such as by way of sewing or stitching) and is substantially continuous with frame-side fabric panel 115 at an opposing end of central fabric panel 110; in this way, at this opposing end of central fabric panel 110, central fabric panel 110 can be said to be attached to frame section 101. Frame-side fabric panel 115 is attached to frame section 101 (such as by way of sewing or stitching), such as to, more specifically, scabbard 108. The material of load sling 103 (as also for other fabric portions of backpack assembly 100) can be any suitable material, for example, nylon, leather, or the like.

According to one embodiment of the present invention, backpack assembly 100 further includes strap assemblies 416A, 116B, 116C, which are each configured for supporting and/or securing load 111 being supported by load sling 103. Strap assemblies 416A include left and right strap assemblies 416A that extend parallel to one another from frame section 101 to main bag 102 and underneath fabric panel 110 of load sling 103, so as to provide support to fabric panel 110 when carrying load 111. Left and right strap assemblies 416A each includes fore and aft straps which are connected to frame section 101 and main bag 102 respectively and are connectable to one another in any suitable manner. For example, the fore and aft straps of strap assemblies 416A may connect with one another using a buckle, wherein one of the fore and aft straps includes the buckle. Alternatively, each of the fore and aft straps of strap assemblies 116C can include a respective connection mechanism which matingly connects with the connection mechanism of the other of the fore or aft straps, wherein each connection mechanism can be, for example, a mating clip portion which clips together with the other clip portion. Though only right strap assembly 416A is shown in FIG. 4, it can be appreciated that left strap assembly 416A mirrors right strap assembly 416A and is thus substantially similar thereto.

Strap assemblies 116B include left and right strap assemblies 116B that extend parallel to one another from frame section 101 to main bag 102, above strap assemblies 416A and below strap assemblies 116C, and to the side of load 111, so as to support and/or secure load 111 on load sling 103. Left and right strap assemblies 116B each includes fore and aft straps which are connected to frame section 101 and main bag 102 respectively and are connectable to one another in any suitable manner. For example, each of the fore and aft straps of strap assemblies 116B can include a respective connection mechanism which matingly connects with the connection mechanism of the other of the fore or aft straps, wherein each connection mechanism can be, for example, a mating clip portion which clips together with the other clip portion; alternatively, fore and aft straps may connect to one another using a buckle. Though only right strap assembly 116B is shown in FIG. 1, it can be appreciated that left strap assembly 116B mirrors right strap assembly 116B and is thus substantially similar thereto.

Strap assemblies 116C include left and right strap assemblies 116C that extend parallel to one another from frame section 101 to main bag 102, above strap assemblies 116B, and to the side of load 111, so as to support and/or secure load 111 on load sling 103. Left and right strap assemblies 116C each includes fore and aft straps which are connected to frame section 101 and main bag 102 respectively and are connectable to one another in any suitable manner. For example, each of the fore and aft straps of strap assemblies 116C can include a respective connection mechanism which matingly connects with the connection mechanism of the other of the fore or aft straps, wherein each connection mechanism can be, for example, a mating clip portion which clips together with the other clip portion; alternatively, fore and aft strap sections may connect to one another using a buckle. Though only right strap assembly 116C is shown in FIG. 1, it can be appreciated that left strap assembly 116C mirrors right strap assembly 116C and is thus substantially similar thereto.

Further, frame section 101, main bag 102, load sling 103, and side strap assemblies 116B, 116C define at least in part a compartment 117 configured for carrying load 111. According to at least one embodiment of the present invention, more specifically frame-side fabric panel 115 of frame section partly defines compartment 117.

Figure 7:
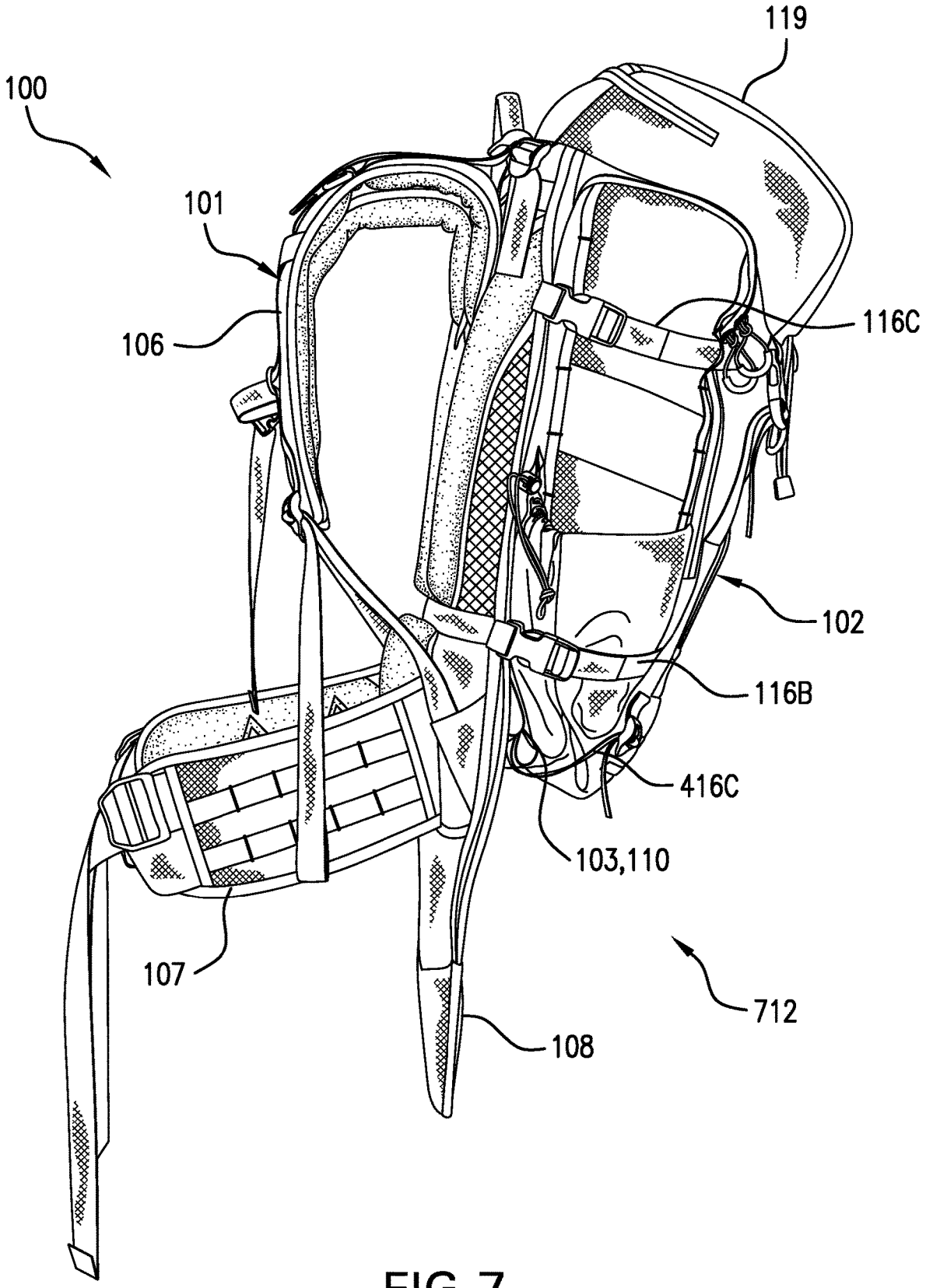
FIG. 7 is a right side perspective view of the backpack assembly of FIG. 1, the load sling being in a retracted position, in accordance with an exemplary embodiment of the present invention.

According to one embodiment of the present invention, backpack assembly 100 further includes a cap 119. Cap 119 is configured for selectively covering opening 118 of main bag 102 (alternatively, any straps associated with cap 119 can optionally be extended such that cap 119 covers at least part of load 111 in load sling 103). Cap 119 is connectable to frame section 101 and main bag 102 by respective connection mechanisms (such as mating clip portions or buckle portions) and optionally straps connecting the connection mechanisms to the respective frame section 101 or main bag 102. Cap 119, in FIG. 7, is shown connected to both frame section 101 and main bag 102.

Figure 2:
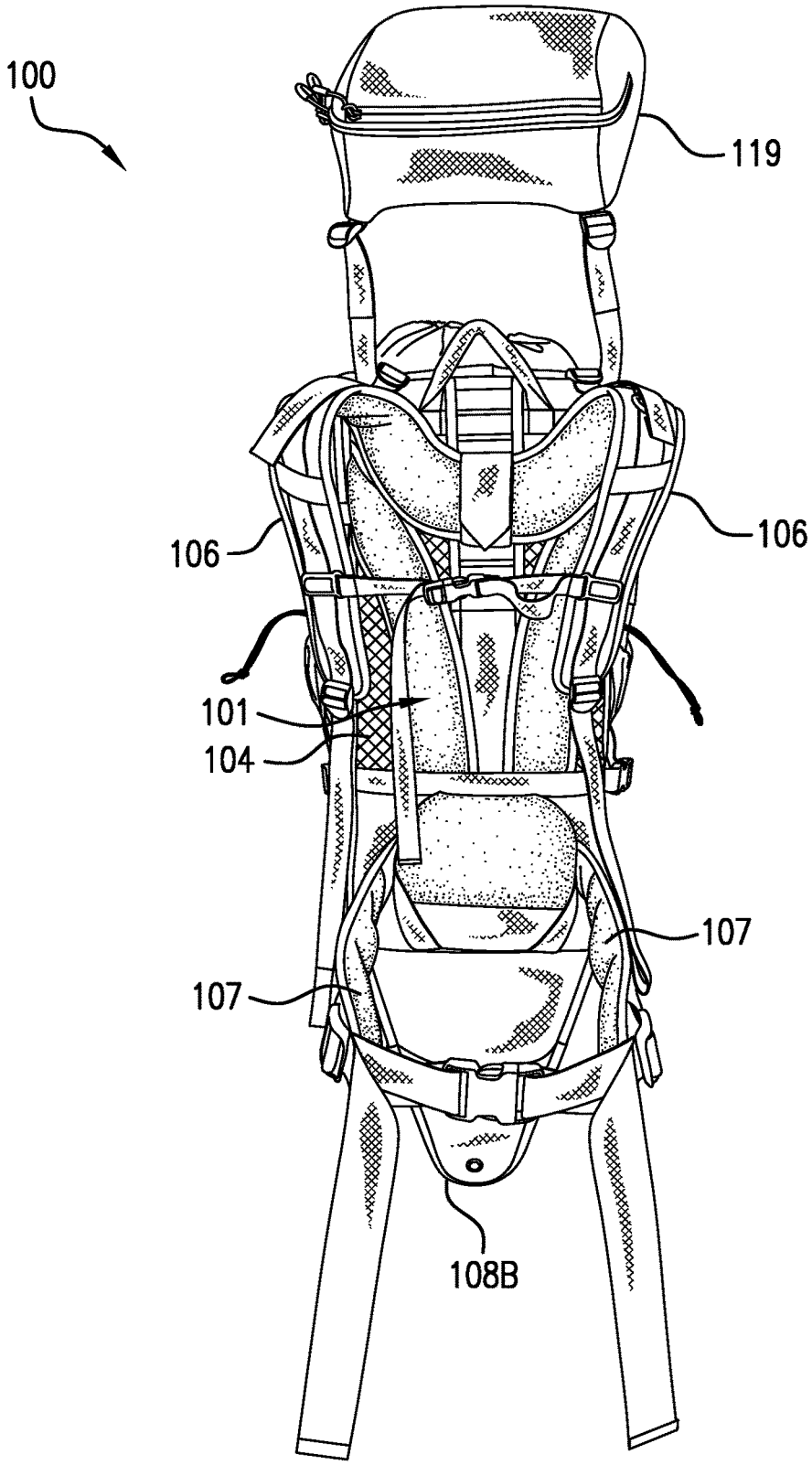
FIG. 2 is a front perspective view of the backpack assembly of FIG. 1, in accordance with an exemplary embodiment of the present invention.

Referring now to FIG. 2, there is shown a front perspective view of backpack assembly 100. Backpack assembly 100 is shown to include frame section 101, base 104, shoulder straps 106, waist belt 107, lower section 108B of scabbard 108, and cap 119.

Figure 3:
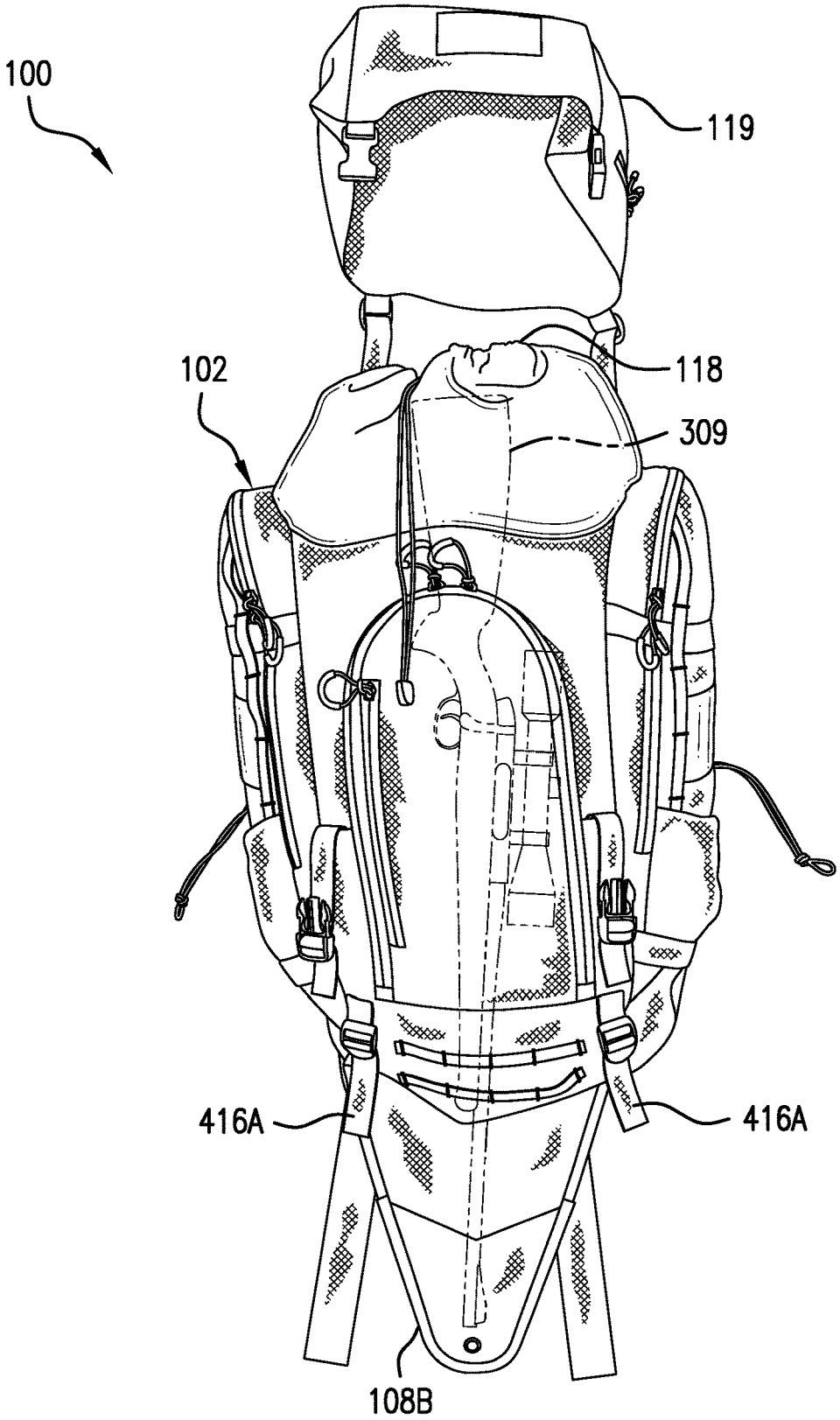
FIG. 3 is a rear perspective view of the backpack assembly of FIG. 1, in accordance with an exemplary embodiment of the present invention.

Referring now to FIG. 3, there is shown a rear perspective view of backpack assembly 100. Backpack assembly 100 is shown to include main bag 102, lower section 108B of scabbard 108, top opening 118, and cap 119. Long gun 309 is shown in FIG. 3 in broken lines.

Referring now to FIG. 4, there is shown a right side perspective view of backpack assembly 100. Backpack assembly 100 is shown to include the structures shown in FIG. 1. Load 111 is shown (in broken lines) as a bag, such as a bag of meat harvested from a successful hunt. Cap 119 is shown secured to main bag 102 (by contrast, cap 119 is shown detached from main bag 102 in FIGS. 1-3).

Figure 5:
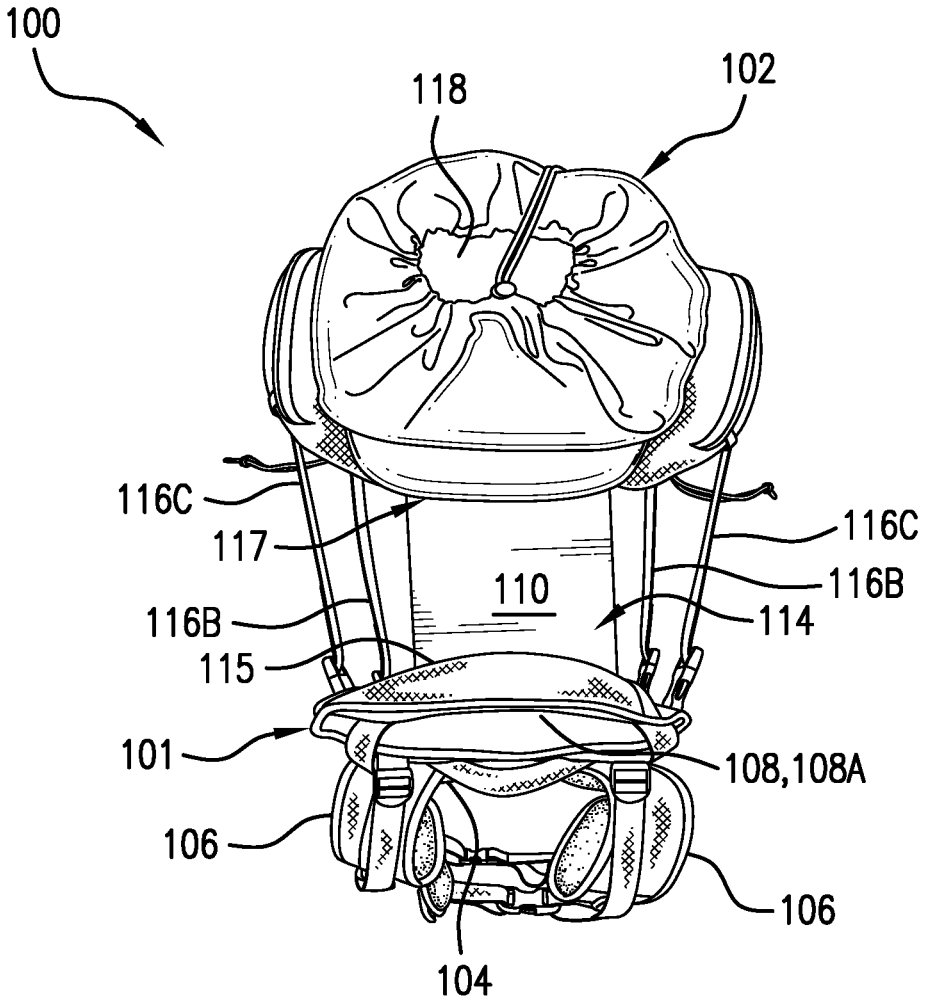
FIG. 5 is a top perspective view of the backpack assembly of FIG. 1, in accordance with an exemplary embodiment of the present invention.

Referring now to FIG. 5, there is shown a top perspective view of backpack assembly 100. For illustrative purposes, load 111 is not shown, cap 119 is removed (not shown), and free ends of cap straps that attach cap 119 to frame section 101 are shown inserted into scabbard 108.

Figure 6:
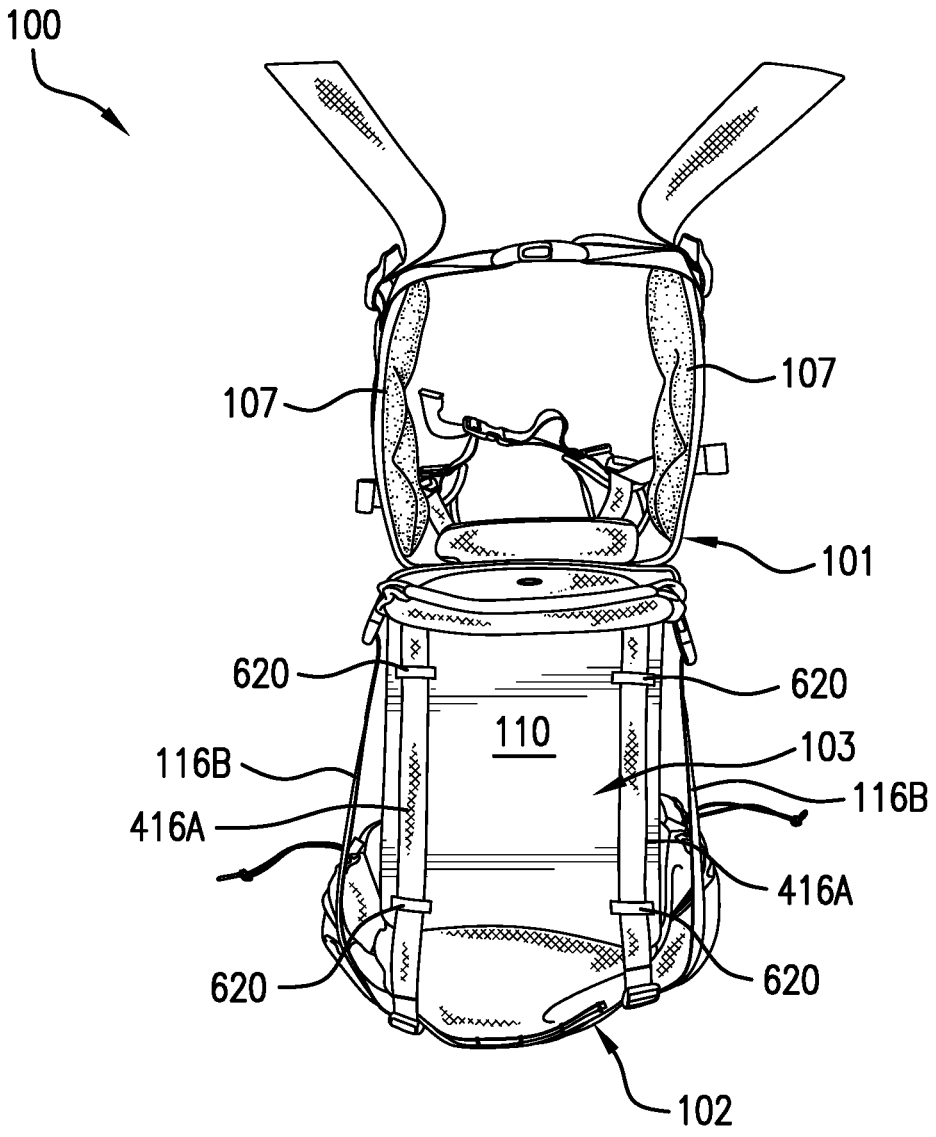
FIG. 6 is a bottom perspective view of the backpack assembly of FIG. 1, in accordance with an exemplary embodiment of the present invention.

Referring now to FIG. 6, there is shown a bottom perspective view of backpack assembly 100. For illustrative purposes, load 111 is not shown, and cap 119 is removed (not shown). Load sling 103 further includes a plurality of loops 620, two loops 620 being associated with right strap assembly 416A and two loops 620 being associated with left strap assembly 416A. Loops 620 are attached to an underside of central fabric panel 110, such that the fore and/or aft strap sections of each strap assembly 416A can proceed through a corresponding one or two loops 620 and thereby be held in place.

Referring now to FIG. 7, there is shown a right side perspective view of the backpack assembly of FIG. 1, but with load sling 103 being in a retracted position 712 (that is, a fully retracted position). When load sling 103 is in retracted position 712, load 111 is not being carried by load sling 103, given that compartment 117 is effectively closed. Further, when load sling 103 is in retracted position 712, strap assemblies 416A, 116B, 116C are tightened, in order to maintain load sling 103 in retracted position 712. Further, cap 119 is shown to be covering top opening 118 of main bag 102. When load sling 103 is in retracted position 712, central fabric panel 110 can be folded and held in place between frame-side fabric panel 115 and main bag 102 (for example, fabric panel 110 can be folded in an accordion-like manner). Long gun 309 is also shown in FIG. 7 in broken lines.

Figure 8:
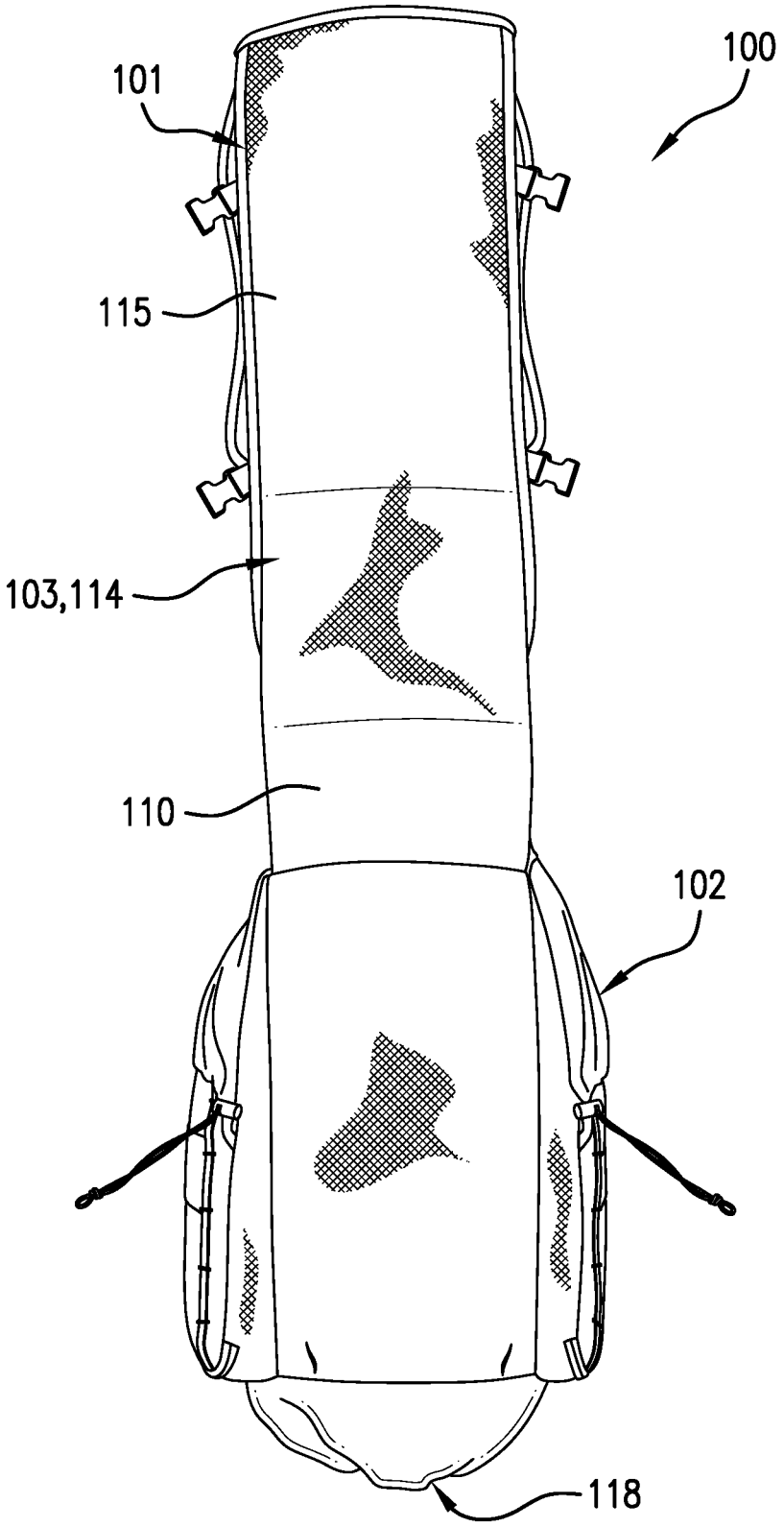
FIG. 8 is a top perspective view of the backpack assembly of FIG. 1 but with certain straps of the backpack assembly released so that certain portions of the frame section and the main bag which face one another in FIG. 1 now face upwardly in FIG. 8, in accordance with an exemplary embodiment of the present invention.

Referring now to FIG. 8, there is shown a top perspective view of backpack assembly 100, but with certain straps of backpack assembly 100 having been released, such that certain portions of frame section 101 and main bag 102 which face one another in FIG. 1 now face upwardly in FIG. 8 (hat 119 is removed for illustrative purposes). More specifically, the clips of strap assemblies 116B, 116C are undone such that the fore and aft sections of each of strap assemblies 116B, 116C are no longer connected, which allows frame section 101 and main bag 102 to be laid out on a floor in a substantially straight line, with central fabric panel 110 being therebetween. In FIG. 8, then, interior side walls defining compartment 117 are visible (these interior side walls are defined at least in part by fabric panel 114 (central fabric panel 110 and frame-side fabric panel 115) and main bag 102.

Figure 9:
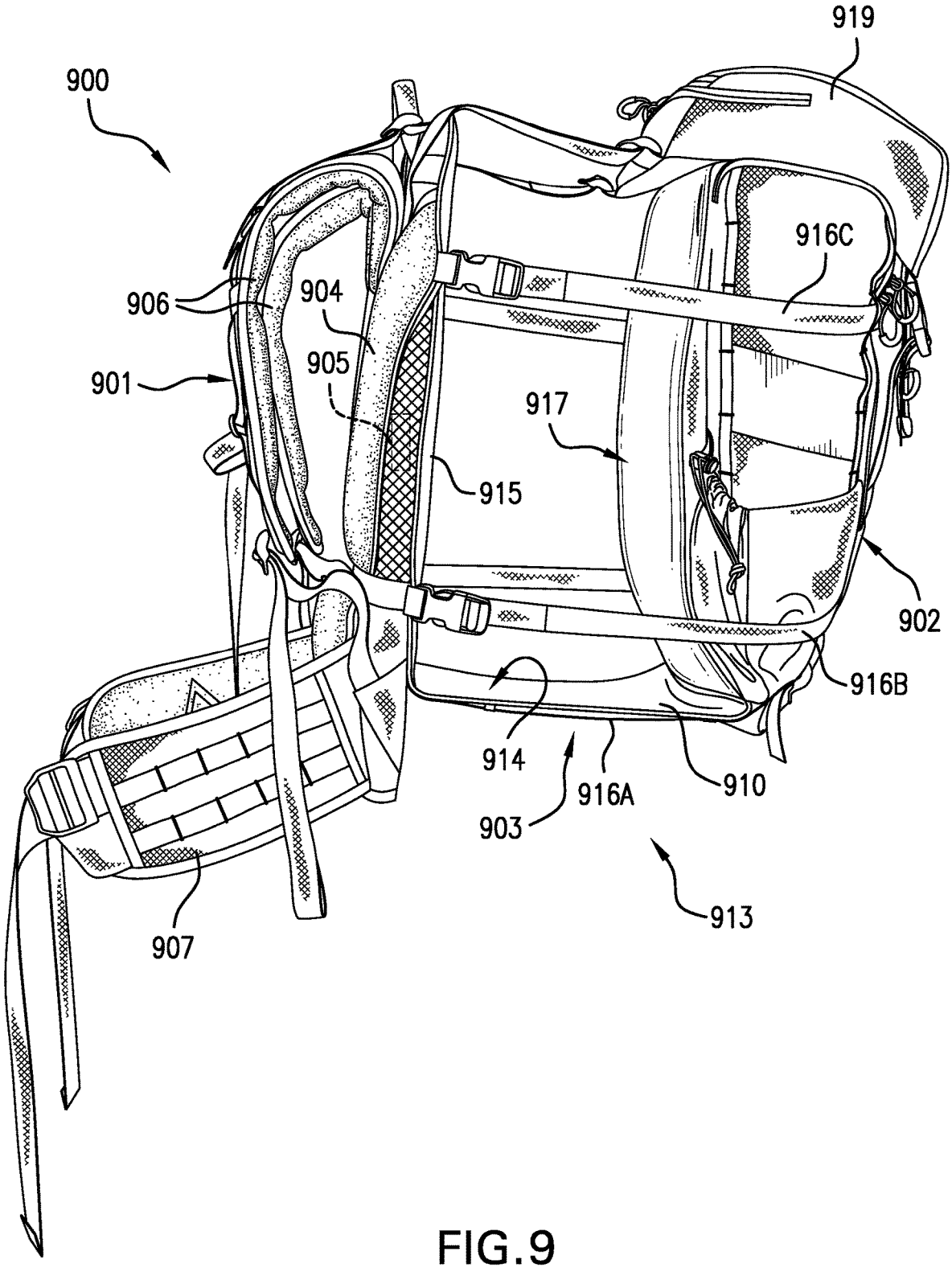
FIG. 9 is a right side perspective view of another embodiment of the backpack assembly, the backpack assembly including a frame section, a main bag, and a load sling, the frame section not including a long gun scabbard, the load sling being in an extended position, in accordance with an exemplary embodiment of the present invention.

Referring now to FIG. 9, there is shown a right side perspective view of backpack assembly 900, according to another exemplary embodiment of the present invention. Prior reference numbers with respect to backpack assembly 100 are increased by a multiple of 100, and thus structures and function of backpack assembly 900 are substantially similar to the structures and function described and shown with respect to FIGS. 1-8, unless otherwise shown and/or described differently. Thus, backpack assembly 100 is labeled as backpack assembly 900 in FIG. 9. The primary difference between backpack assembly 100 and backpack assembly 900 is that backpack assembly 900 does not have long gun scabbard 108 (and thus lacks a long gun scabbard). Backpack assembly 900 includes frame section 901, main bag 902, and load sling 903. Frame section 901 includes base 904, internal frame 906 (shown schematically), shoulder straps 906, and waist belt 907. Main bag 902 includes a top opening (like 118, but not shown here). Load sling 903 includes overall fabric panel 914, which includes central fabric panel 910 and frame-side fabric panel 915. Frame-side fabric panel 915 is attached directly to base 904 (in the absence of a long gun scabbard), and thus central fabric panel 910 also attaches directly to base 904. Load sling 903 is configured for supporting load 111. Load 111 is held at least substantially in compartment 917. Backpack assembly 900 further includes strap assemblies 916A (which can be maintained close to central fabric panel 910 by loops corresponding to loops 620), 916B, 916C and cap 919. Load sling 903 is shown in extended position 913.

In use, backpack assembly 100 is used, then long gun 309 can be stored and carried in scabbard 108 of backpack assembly 100. If backpack assembly 900 is used, then long gun 309 will not be carried in a scabbard of backpack assembly 900. Regardless of whether the backpack assembly includes such a scabbard 108, load sling 103, 903 can be used to carry load 111. Load sling 103, 903 can be moved from retracted position 712 to extended position 113, 913 (or at an intermediate position therebetween) by adjusting and thereby lengthening strap assemblies 416A, 916A, 116B, 916B, 116C, 916C, and also by releasing (thereby separating cap 119, 919 from either frame section 101, 901 or main bag 102, 902) or lengthening (but not releasing) the straps associated with cap 119, 919. Load 111 can be inserted into compartment 117, 917 so as to be carried therein. Strap assemblies 416A, 916A, 116B, 916B, 116C, 916C can be tightened so as to secure load 111 in compartment 117, 917. When the user desires to remove load 111 from compartment 117, 917, user can loosen strap assemblies 416A, 916A, 116B, 916B, 116C, 916C and remove load 111 from compartment 117, 917. After removing load 111 from compartment 117, 917, user can tighten strap assemblies 416A, 916A, 116B, 916B, 116C, 916C so as to return load sling 103, 903 to retracted position 712.

Figure 10:
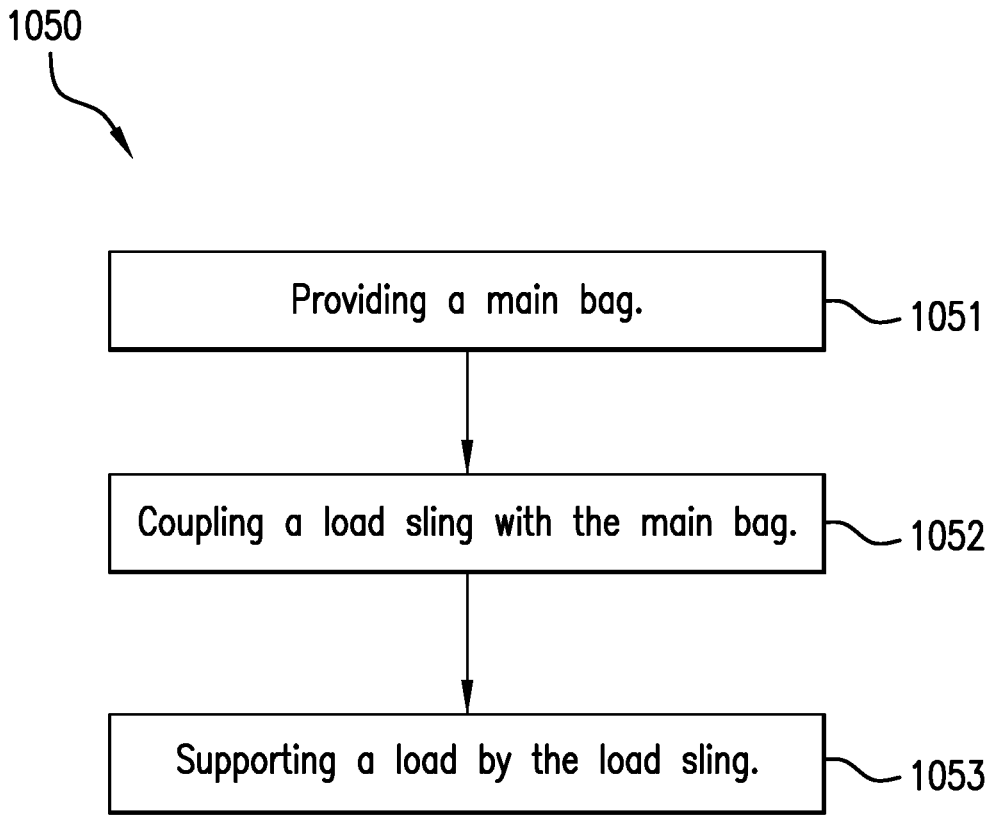
FIG. 10 is a flow diagram showing a method of using the backpack assembly, in accordance with an exemplary embodiment of the present invention.

Referring now to FIG. 10, there is shown a flow diagram showing a method 1050 of using backpack assembly 100, 900, the method 1050 including the steps of: providing 1051 main bag 102, 902; coupling 1052 load sling 103, 903 with main bag 102, 902; and supporting load 111 by load sling 103, 903. Backpack assembly 100, 900 further includes frame section 101, 901 coupled with load sling 103, 903, frame section 101, 901 including internal frame 105, 905. Load sling 103, 903 includes fabric panel 110, 910 which is flexible and is at least in part connected to and positioned between frame section 101, 901 and main bag 102, 902. Frame section 101, 901, main bag 102, 902, and load sling 103, 903 defines at least in part compartment 117, 917 configured for carrying load 111. Backpack assembly 100, 900 further includes a plurality of strap assemblies 416A, 916A, 116B, 916B, 116C, 916C that are configured for at least one of supporting and securing load 111. The plurality of strap assemblies 416A, 916A, 116B, 916B, 116C, 916C include four side strap assemblies 116B, 916B, 116C, 916C and two bottom strap assemblies 416A, 916A. Load sling 103, 903 is configured for moving between retracted position 712 and extended position 113, 913. Frame section 101 includes a long gun scabbard 108. Backpack assembly 900 does not include a long gun scabbard.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A backpack assembly, comprising:

a main bag;

a load sling coupled with the main bag and configured for supporting a load;

a frame section coupled with the load sling, the load sling including a fabric panel which is flexible and is at least in part connected to and positioned between the frame section and the main bag; and at least one strap assembly that extends from the frame section to the main bag and underneath the fabric panel of the load sling so as to provide support to the fabric panel when carrying the load.

2. The backpack assembly of claim 1, wherein the frame section includes an internal frame.

3. The backpack assembly of claim 1, wherein the frame section, the main bag, and the load sling define at least in part a compartment configured for carrying the load.

4. The backpack assembly of claim 3, further comprising a plurality of straps that are configured for at least one of supporting and securing the load.

5. The backpack assembly of claim 4, wherein the plurality of straps includes four side straps and two bottom straps.

6. The backpack assembly of claim 4, wherein the load sling is configured for moving between a retracted position and an extended position.

7. The backpack assembly of claim 6, wherein the frame section includes a long gun scabbard.

8. The backpack assembly of claim 6, wherein the backpack assembly does not include a long gun scabbard.

9. A method of using a backpack assembly, the method comprising the steps of:

providing that the backpack assembly includes a main bag and a load sling;

coupling the load sling with the main bag, the backpack assembly further including a frame section and at least one strap assembly, the frame section being coupled with the load sling, the load sling including a fabric panel which is flexible and is at least in part connected to and positioned between the frame section and the main bag, the at least one strap assembly extending from the frame section to the main bag and underneath the fabric panel of the load sling so as to provide support to the fabric panel when carrying the load; and supporting a load by the load sling.

10. The method of claim 9, wherein the frame section includes an internal frame.

11. The method of claim 9, wherein the frame section, the main bag, and the load sling define at least in part a compartment configured for carrying the load.

12. The method of claim 11, further comprising a plurality of straps that are configured for at least one of supporting and securing the load.

13. The method of claim 12, wherein the plurality of straps includes four side straps and two bottom straps.

14. The method of claim 12, wherein the load sling is configured for moving between a retracted position and an extended position.

15. The method of claim 14, wherein the frame section includes a long gun scabbard.

16. The method of claim 14, wherein the backpack assembly does not include a long gun scabbard.

* * * * *